US007585797B2

(12) United States Patent
Vogel et al.

(10) Patent No.: US 7,585,797 B2
(45) Date of Patent: Sep. 8, 2009

(54) LAYERED DISPERSIBLE SUBSTRATE

(75) Inventors: Nathan John Vogel, Neenah, WI (US); Dana Lynn Ramshak, Greenville, WI (US); Kevin Christopher Possell, Middleton, WI (US); Robert Irving Gusky, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 330 days.

(21) Appl. No.: 11/799,420

(22) Filed: Apr. 30, 2007

(65) Prior Publication Data

US 2008/0268205 A1 Oct. 30, 2008

(51) Int. Cl.
*D04H 1/00* (2006.01)

(52) U.S. Cl. ..... 442/361; 442/327; 428/156

(58) Field of Classification Search ..... 442/381, 442/415, 416, 417

See application file for complete search history.

(56) References Cited

U.S. PATENT DOCUMENTS

| | | | |
|---|---|---|---|
| 4,666,647 | A | 5/1987 | Enloe et al. |
| 4,761,258 | A | 8/1988 | Enloe |
| 5,281,306 | A | 1/1994 | Kakiuchi et al. |
| 5,312,883 | A | 5/1994 | Komatsu et al. |
| 5,529,665 | A | 6/1996 | Kaun |
| 6,202,259 | B1 | 3/2001 | Burr et al. |
| 6,599,848 | B1 | 7/2003 | Chen et al. |
| 6,673,358 | B1 | 1/2004 | Cole et al. |
| 6,683,143 | B1 | 1/2004 | Mumick et al. |
| 6,905,697 | B2 | 6/2005 | Baumã-Ller et al. |
| 6,924,042 | B2 | 8/2005 | Von Paleske |
| 6,960,371 | B2 | 11/2005 | Bunyard et al. |
| 6,994,865 | B2 | 2/2006 | Branham et al. |
| 7,101,456 | B2 | 9/2006 | Bunyard et al. |
| 7,141,519 | B2 | 11/2006 | Bunyard et al. |
| 7,157,389 | B2 | 1/2007 | Branham et al. |
| 2003/0220042 | A1 | 11/2003 | Lostocco et al. |

(Continued)

FOREIGN PATENT DOCUMENTS

EP 1 253 231 A2 10/2002

(Continued)

OTHER PUBLICATIONS

"Metso Paper No. 25—Measuring the Hardness of Rubber Covered Rolls (Plastometer Test)," Metso Paper, Inc., Finland, 2 pages.

(Continued)

*Primary Examiner*—Lynda Salvatore
(74) *Attorney, Agent, or Firm*—R. Joseph Foster, III; Scott A. Baum

(57) ABSTRACT

A dispersible nonwoven web having at least three layers including a first outer layer, a middle layer, and a second outer layer. The first and the second outer layers including a plurality of short fibers, a triggerable binder, and at least one of the first or second outer layers including a plurality of long fibers. The middle layer including a plurality of short fibers, a triggerable binder, and optionally a plurality of long fibers. The dispersible nonwoven web having a weight percent of the long fibers in at least one of the first or the second outer layers that is greater than a weight percent of the long fibers in the middle layer.

21 Claims, 5 Drawing Sheets

U.S. PATENT DOCUMENTS

| | | | |
|---|---|---|---|
| 2004/0058600 | A1 | 3/2004 | Bunyard et al. |
| 2005/0129897 | A1 | 6/2005 | Zhou et al. |
| 2005/0239359 | A1 | 10/2005 | Jones et al. |
| 2006/0003649 | A1 | 1/2006 | Runge et al. |
| 2006/0008621 | A1 | 1/2006 | Gusky et al. |
| 2006/0154547 | A1 | 7/2006 | Hurley et al. |
| 2006/0194498 | A1 | 8/2006 | Yasumitsu et al. |
| 2006/0252877 | A1 | 11/2006 | Farwaha et al. |

FOREIGN PATENT DOCUMENTS

| | | | |
|---|---|---|---|
| EP | 1 285 985 | A1 | 2/2003 |
| EP | 1 589 138 | A1 | 10/2005 |
| GB | 2 376 695 | A | 12/2002 |
| WO | WO 01/66345 | A1 | 9/2001 |
| WO | WO 01/83866 | A2 | 11/2001 |
| WO | WO 03/005874 | A1 | 1/2003 |
| WO | WO 2004/026351 | A2 | 4/2004 |
| WO | WO 2006/102360 | A2 | 9/2006 |
| WO | WO 2006/118746 | A1 | 11/2006 |

OTHER PUBLICATIONS

American Society for Testing Materials (ASTM) Designation: D 531-00, "Standard Test Method for Rubber Property—Pusey and Jones Indentation," pp. 1-4, published Jan. 2001.

American Society for Testing Materials (ASTM) Designation: D1117-80, "Standard Test Methods of Testing Nonwoven Fabrics," pp. 240-246, published May 1980.

American Society for Testing Materials (ASTM) Designation: E1279-89 (Reapproved 1995), "Standard Test Method for Biodegradation By a Shake-Flask Die-Away Method," pp. 1-5, published Mar. 1989.

TAPPI Official Test Method T 271 om-02, "Fiber Length of Pulp and Paper by Automated Optical Analyzer Using Polarized Light," published by the TAPPI Press, Atlanta, Georgia, revised 2002, pp. 1-6.

LAYERED DISPERSIBLE SUBSTRATE

BACKGROUND

Wet wipes are used for a variety of purposes such as cleaning household surfaces and personal body cleansing. The substrate from which the wet wipe is manufactured can be selected from a wide variety of materials. Frequently, nonwoven substrates are used to produce wet wipes due to their desirable properties and low cost of manufacture. Recently, more emphasis is being placed on providing wet wipes having the ability to disperse when disposed of in the toilet bowl after use. Several municipalities have banned the disposal of non-dispersible wet wipes in municipal sewer systems. The non-dispersible wet wipes can plug typical sewage handling components such as pipes, pumps, lift stations, or screens causing operational issues for the treatment plant.

When manufacturing a dispersible wet wipe, it is often difficult to achieve sufficient in-use strength while also providing desirable dispersibility characteristics. Making the wet wipe stronger often leads to poor dispersibility or the inability of the wet wipe to disperse or break up. Making the wet wipe weaker provides enhanced dispersibility characteristics, but jeopardizes in-use performance requirements because the wet wipe could rip or tear during use. Therefore, what is needed is a dispersible wet wipe structure that has improved in-use strength while achieving desirable dispersibility characteristics.

SUMMARY

The inventors have discovered that by layering the fibers forming the basesheet in a specific manner, the wet wipe's wet tensile strength can be increased or maintained without adversely affecting the dispersibility characteristics of the wet wipe. In one embodiment, the invention resides in a dispersible nonwoven web having at least three layers including a first outer layer, a middle layer, and a second outer layer. The first and the second outer layers including a plurality of short fibers, a triggerable binder, and at least one of the first or second outer layers including a plurality of long fibers. The middle layer including a plurality of short fibers, a triggerable binder, and optionally a plurality of long fibers. The dispersible nonwoven web having a weight percent of the long fibers in at least one of the first or the second outer layers that is greater than a weight percent of the long fibers in the middle layer.

BRIEF DESCRIPTION OF THE DRAWINGS

The above aspects and other features, aspects, and advantages of the present invention will become better understood with regard to the following description, appended claims, and accompanying drawings in which:

Figure 1:
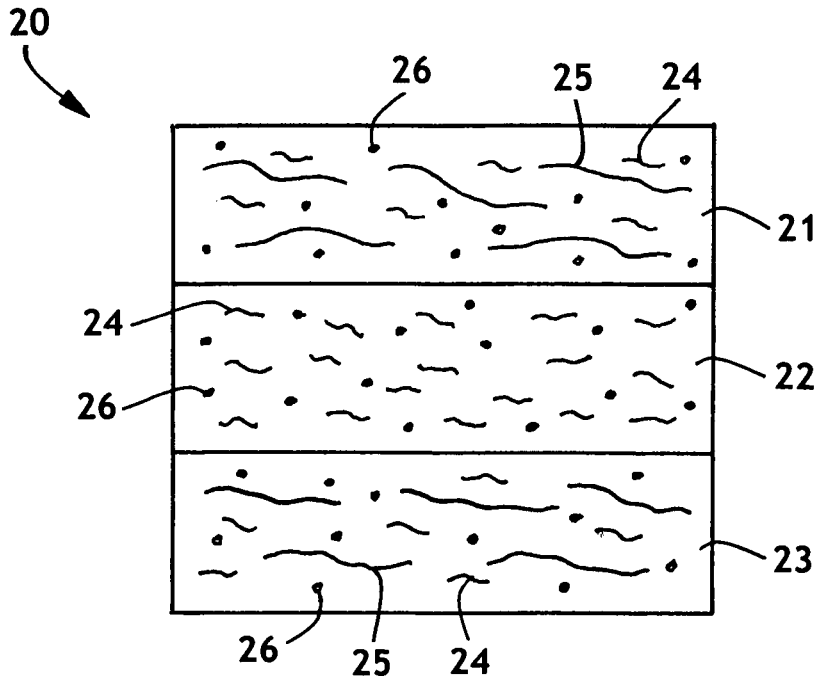
FIG. 1 is a schematic cross section of a dispersible wet wipe substrate.

Repeated use of reference characters in the specification and drawings is intended to represent the same or analogous features or elements of the invention.

Definitions

As used herein, forms of the words "comprise", "have", and "include" are legally equivalent and open-ended. Therefore, additional non-recited elements, functions, steps or limitations may be present in addition to the recited elements, functions, steps, or limitations.

As used herein a "triggerable binder" is a formulation capable of binding the fibers in a fibrous substrate to form a nonwoven web that is insoluble in a wetting composition comprising an insolubilizing agent, but is dispersible or soluble in disposal water such as that found in the toilet tank, toilet bowl, or waste water system. As such, a nonwoven web utilizing a triggerable binder will break apart, disperse, or substantially weaken when flushed down a toilet for disposal. For example, a triggerable binder using an alcohol insolubilizing agent is disclosed in U.S. Patent Application Publication US 2006/0003649 published by Runge et al. on Jan. 5, 2006 entitled Dispersible Alcohol/Cleaning Wipes Via Topical or Wet-End Application of Acrylamide Or Vinylamide/Amine Polymers. As another example, a triggerable binder using a salt insolubilizing agent is disclosed in U.S. Pat. No. 5,312,883 issued to Komatsu et al. on May 17, 1994 entitled Water-Soluble Polymer Sensitive to Salt.

As used herein a "salt triggerable binder" is a formulation capable of binding the fibers in a fibrous substrate to form a nonwoven web that is insoluble in a wetting composition comprising a predetermined concentration of sodium chloride, sodium sulfate, sodium citrate, potassium, or other mono or divalent salt acting as the insolubilizing agent, but is dispersible or soluble in disposal water such as that found in the toilet tank, toilet bowl or waste water system. The disposal water can contain up to 200 ppm $Ca^{2+}$ and or $Mg^{2+}$ ions. As such, a nonwoven web utilizing a salt triggerable binder will break apart, disperse, or substantially weaken when flushed down a toilet for disposal. Examples of salt triggerable binders are disclosed in U.S. Pat. No. 5,312,833; in U.S. Pat. No. 6,683,143 issued to Mumick et al. on Jan. 27, 2004 entitled Ion-Sensitive, Water-Dispersible Polymers, a Method of Making Same and Items Using Same; in U.S. Pat. No. 7,141,519 issued to Bunyard et al. on Nov. 28, 2006 entitled Ion Triggerable, Cationic Polymers, A Method of Making Same and Items Using Same; in U.S. Pat. No. 7,157,389 issued to Branham et al. on Jan. 2, 2007 entitled Ion Triggerable, Cationic Polymers, A Method of Making Same and Items Using Same; in U.S. Patent Application Publication US 2006/0252877 by Farwah et al. on Nov. 9, 2006 entitled Salt-Sensitive Binder Compositions With N-Alkyl Acrylamide and Fibrous Articles Incorporating Same; in U.S. Patent Application Publication US 2005/0239359 by Jones et al. on Oct. 27, 2005 entitled Wet Tensile Strength Nonwoven Webs.

As used herein, "short fiber" is a fiber having a discrete fiber length less than about 5.5 mm, and desirably between about 0.2 mm to about 5 mm. Short fiber length can be measured by TAPPI test method T 271 om-02 entitled *Fiber Length of Pulp and Paper by Automated Optical Analyzer Using Polarized Light*. The test method is an automated method by which the fiber length distributions of pulp and paper in the range of 0.1 mm to 7.2 mm can be measured using light polarizing optics. Short fiber length is measured and calculated as a length weighted mean fiber length according to the test method.

As used herein "long fiber" is a fiber having a discrete or cut fiber length between about 5.6 mm to about 40 mm, and desirably between about 6 mm to about 12 mm. Fiber lengths greater than 5.5 mm can be directly measured by an appropriate ruler or scale using a microscope or measuring technique known to those of skill in the art.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

Referring to FIG. 1, a dispersible nonwoven web 20 is schematically illustrated. The dispersible nonwoven web can include a first outer layer 21, a middle layer 22, and a second outer layer 23 that forms a single ply, integrated, dispersible nonwoven web. The first and second outer layers (21, 23) include a plurality of short fibers 24, a plurality of long fibers 25, and a triggerable binder 26 that assists in forming fiber to fiber bonds. The middle layer 22 includes a plurality of short fibers 24 and the triggerable binder 26. Optionally, the middle layer 22 can include a plurality of long fibers 26, but percentage of the long fibers in the middle layer should be less than the percentage of long fibers in at least one of the outer layers (21, 23).

When the dispersible nonwoven web 20 is placed into disposal water, the fiber to fiber bonds formed within the web by the triggerable binder 26 begin to weaken causing the dispersible nonwoven web to break apart, disperse, lose integrity, or substantially weaken. Without wishing to be bound by theory, the long fibers 25 in the outer layers (21, 23) are believed to act similar to the reinforcement steel bars (rebar) often placed within concrete structures to strengthen them. The long fibers 25 (rebar) are believed to enhance the strength characteristics of the outer layers by helping to better stabilize the matrix of short fibers 24 and the triggerable binder 26, which can be conceptually compared to concrete when cured. By using fewer long fibers 25 or no long fibers in the middle layer 22, the strength or integrity of the middle layer can be less than the strength or integrity of the outer layers (21, 23). When the dispersible nonwoven web 20 is placed into disposal water, the middle layer 22 begins to break apart faster than the outer layers (21, 23) and may cause the web to delaminate exposing additional surfaces for the water to attack, thereby enhancing the rate of dispersibility. As such, a stronger dispersible nonwoven web can be made, which still readily breaks apart when placed into disposal water.

Figure 2:
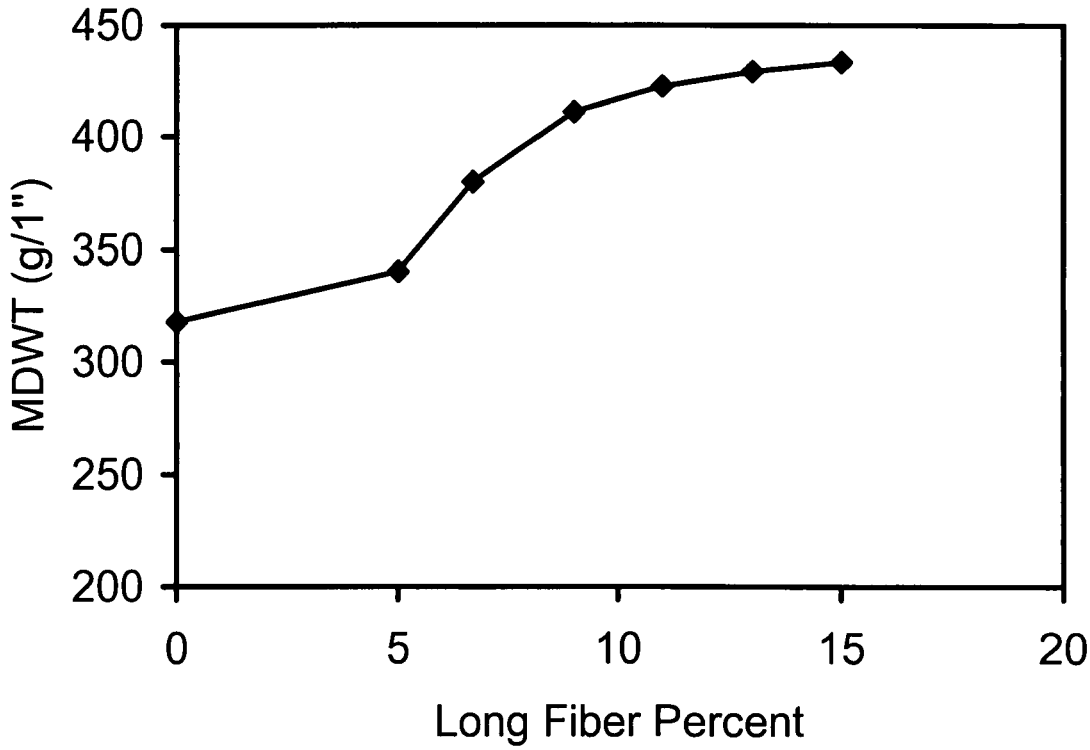
FIG. 2 is a graph of machine direction wet tensile strength versus percent of long fibers for one embodiment of a dispersible wet wipe.

Referring to FIG. 2, the inventors have determined that the machine direction wet tensile strength (MDWT) of the dispersible nonwoven web 20 in a salt solution when using a salt triggerable binder 26 increases as the weight percentage of long fibers 25 is increased in the two outer layers (21, 23). The dispersible nonwoven web 20 tested contained approximately zero weight percent of long fibers in the middle layer 22. The long fiber weight percentages for FIG. 2 are expressed as a percentage of the total basis weight of the dispersible nonwoven web, with each outer layer (21, 23) containing approximately half of the total amount. The data for FIG. 2 represents one embodiment of the dispersible nonwoven web 20. As seen, the increase in MDWT is modest until the total weight percentage of the long fibers reaches about 5 percent of the total basis weight (approximately 5 weight percent for the total weight of fibers in each outer layer). The increase in wet tensile strength thereafter is relatively steep as the weight percent of the long fibers increases from about 5 percent to about 12 percent of the total weight of the fibers in the nonwoven web (approximately 5 to approximately 12 weight percent for the total weight of fibers in each outer layer). Thereafter, the increase in wet tensile strength is minimal as the weight percent of the long fibers is increased above 12 weight percent of the total weight of fibers in the nonwoven web.

Again, without wishing to be bound by theory, a minimum mass of long fibers is believed to be needed to effectively reinforce the outer layers by creating bonds between the short fibers and the long fibers thereby enhancing the wet tensile strength similar to adding rebar to concrete. Increasing the weight percent of long fibers above the minimum mass produces further increases in the wet tensile strength by forming additional long fiber to short fiber bonds. However, once the weight percent of long fibers reaches an upper threshold, further increases in tensile strength are negligible because more of the long fibers begin to bond to other long fibers instead of to the short fibers thereby reducing the effectiveness of adding the additional long fibers.

In various embodiment of the invention, the weight percent of the long fibers in the first and second outer layers (21, 23) together as a percent of the total weight of fibers in the dispersible nonwoven web 20 can be between 1 percent to about 15 percent, between about 4 percent to about 13 percent, between about 5 percent to about 12 percent, or between about 6 percent to about 10 percent.

When manufacturing the dispersible nonwoven web, the weight percentage of the long fibers as a percentage of the total weight of the fiber mix for that specific layer can be approximately twice the percentages expressed above based on the total weight of the dispersible nonwoven web. Thus, the weight percent of the long fibers as a percentage of an individual layer's basis weight can be between 2 percent to about 30 percent, between about 8 percent to about 26 percent, between about 10 percent to about 24 percent, or between about 12 percent to about 20 percent.

Furthermore, the weight percent of the long fibers in the first and second outer layers (21, 23) can be the same or different depending on the particular dispersibility and strength characteristics needed. For example, more long fibers may be added to the first outer layer 21 and less long fibers added to the second outer layer 23. Desirably, the weight percent of the long fibers in the first and second outer layers (21, 23) is approximately the same. Adjusting the fibers in this manner can produce two stronger outer layers and a weaker middle layer.

To assist with improved dispersibility of the dispersible nonwoven web 20, the middle layer 22 should have a lower weight percentage of long fibers 25 on a per layer basis than at least one of the outer layers (21, 23). Desirably, the middle layer 22 contains a lower weight percentage of long fibers 25 on a per layer basis than both of the outer layers (21, 23). In various embodiments of the invention, the weight percent of long fibers in the middle layer 22 as a percent of the total weight of fibers for the dispersible nonwoven web can be between about 0 percent to about 10 percent, between about 0 percent to about 5 percent, between about 0 percent to about 2 percent, or between about 0 percent to about 1 percent. Expressed as a weight percentage of the total fiber mix for the middle layer only, the percentage of long fibers in the middle layer can be between about 0 percent to about 20 percent, or between about 0 percent to about 10 percent, between about 0 percent to about 4 percent, or between about 0 percent to about 2 percent. In some embodiments of the invention, it may be desirable to include long fibers in the middle layer 22 to increase the dispersible nonwoven web's strength. In other embodiments, it may be desirable to minimize or eliminate the long fibers (zero weight percent of long fibers) in the middle layer 22 to maximize dispersibility. In one embodiment, the middle layer 22 contained less than about 0.5 weight percent long fibers.

To further enhance the dispersibility of the dispersible nonwoven web 20, the amount of triggerable binder 26 can be changed between the various layers. For example, adding more triggerable binder 26 to the outer layers (21, 23) and less triggerable binder to the middle layer 22, can produce a dispersible nonwoven web with stronger outer layers and a weaker middle layer. Since the middle layer is weaker as a result of less triggerable binder, it can degrade faster. In various embodiments of the invention, the weight percent of the triggerable binder in the outer layers (21, 23) can be greater than or equal to the weight percent of the triggerable binder in the middle layer 22.

The nonwoven web 20 can be produced by forming an air laid nonwoven web containing cellulosic fibers (typically short fibers) and synthetic fibers (typically long fibers). Other manufacturing methods such as bonded-carded webs, spunlace webs, hydroentangled webs, wet laid webs and the like can be used to form the nonwoven web. The formed air laid web is then compacted, optionally embossed, and treated with the triggerable binder material. The triggerable binder material can be sprayed onto the air laid web. For most applications, for instance, the triggerable binder material is applied to both sides of the web. After application of the triggerable binder material, the air laid web can be cured and dried.

Figure 3:
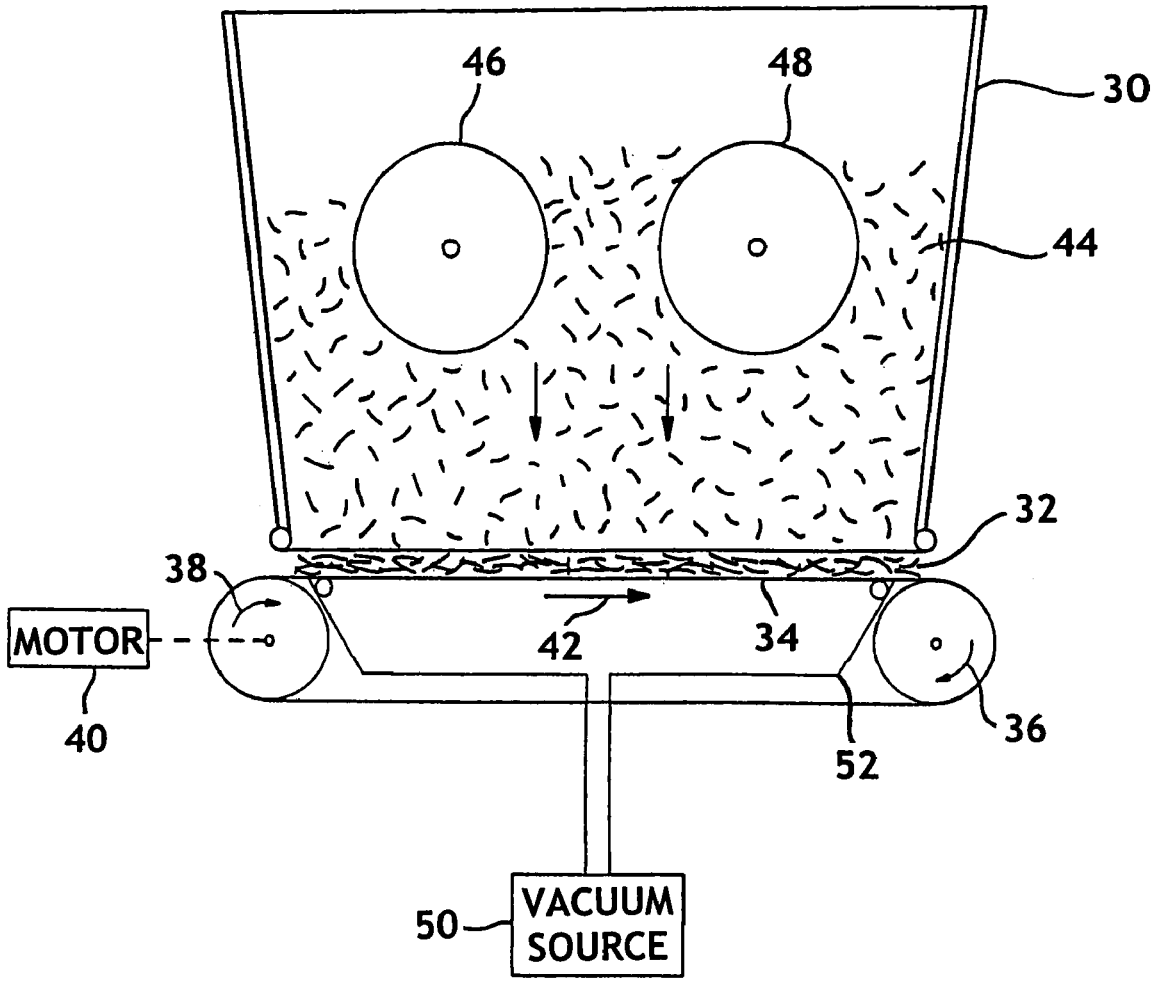
FIG. 3 is a schematic illustration of an air laying forming apparatus.
Figure 4:
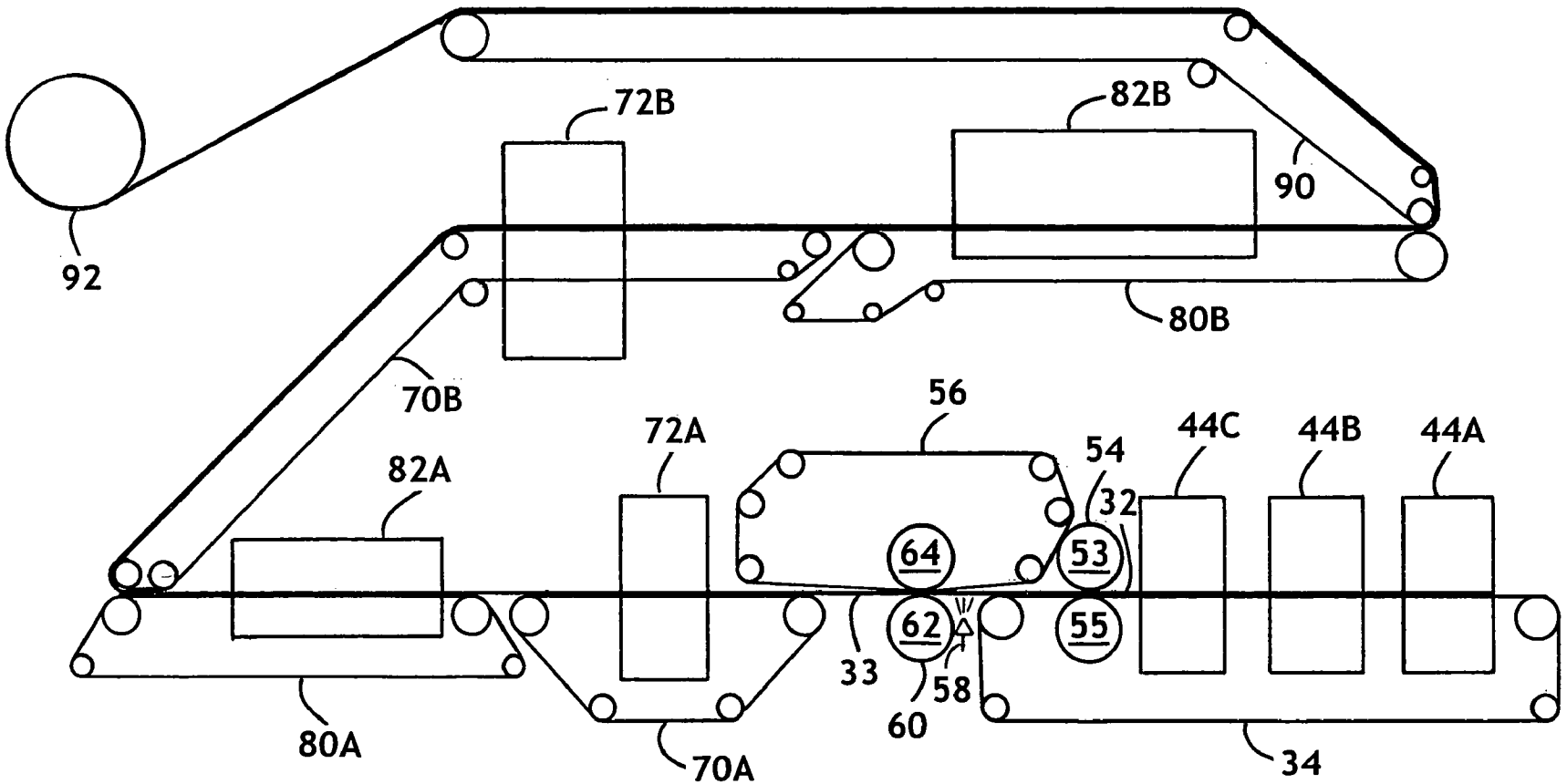
FIG. 4 is a schematic illustration of an air laying process to produce an air laid web.

One embodiment of a process for forming an air laid web will now be described in detail with particular reference to FIGS. 3 and 4. It should be understood that the air laying apparatus illustrated in FIGS. 3 and 4 is provided for exemplary purposes only and that any suitable air laying equipment may be used. Referring to FIG. 3, an air laying forming station 30 is shown which produces an air laid web 32 on a forming fabric or screen 34. The forming fabric 34 can be in the form of an endless belt mounted on support rollers 36 and 38. A suitable driving device, such as an electric motor 40 rotates at least one of the support rollers 38 in a direction indicated by the arrows at a selected speed. As a result, the forming fabric 34 moves in a machine direction indicated by the arrow 42.

The forming fabric 34 can be provided in other forms as desired. For example, the forming fabric can be in the form of a circular drum which can be rotated using a motor as disclosed in U.S. Pat. Nos. 4,666,647, 4,761,258, or U.S. Pat. No. 6,202,259, which are incorporated herein by reference. The forming fabric 34 can be made of various materials, such as plastic or metal.

Various suitable forming fabrics for use with the invention can be made from woven synthetic strands or yarns. One suitable forming fabric is an ElectroTech 100S, available from Albany International having an office in Albany, N.Y. The ElectroTech 100S fabric is a 97 mesh by 84 count fabric with an approximate air permeability of 575 cfm, an approximate caliper of 0.048 inch, and a percent open area of approximately 0 percent.

As shown, the air laying forming station 30 includes a forming chamber 44 having end walls and side walls. Within the forming chamber 44 are a pair of material distributors 46 and 48 which distribute fibers and/or other particles inside the forming chamber 44 across the width of the chamber. The material distributors 46 and 48 can be, for instance, rotating cylindrical distributing screens.

In the embodiment shown in FIG. 3, a single forming chamber 44 is illustrated in association with the forming fabric 34. It is understood that more than one forming chamber can be included in the system. By including multiple forming chambers, layered webs can be formed in which each layer is made from the same or different materials.

Air laying forming stations, as shown in FIG. 3, are available commercially through Dan-Webforming International LTD. of Aarhus, Denmark. Other suitable air laying forming systems are also available from M & J Fibretech of Horsens, Denmark. As described above, any suitable air laying forming system can be used.

As shown in FIG. 3, below the air laying forming station 30 is a vacuum source 50, such as a conventional blower, for creating a selected pressure differential through the forming chamber 44 to draw the fibrous material against the forming fabric 34. If desired, a blower can also be incorporated into the forming chamber 44 for assisting in blowing the fibers down onto the forming fabric 34.

In one embodiment, the vacuum source 50 is a blower connected to a vacuum box 52, which is located below the forming chamber 44 and the forming fabric 34. The vacuum source 50 creates an airflow indicated by the arrows positioned within the forming chamber 44. Various seals can be used to increase the positive air pressure between the chamber and the forming fabric surface.

During operation, typically a fiber stock is fed to one or more defibrators (not shown) and fed to the material distributors 46 and 48. The material distributors distribute the fibers evenly throughout the forming chamber 44 as shown. Positive airflow created by the vacuum source 50, and possibly an additional blower, forces the fibers onto the forming fabric 34, thereby forming an air laid nonwoven web 32.

The material that is deposited onto the forming fabric 34 will depend upon the particular application. The fiber material that can be used to form the air laid web 32, for instance, can include natural fibers alone or in combination with synthetic fibers. "Natural fibers" as used herein include fibers obtained from vegetables, plants, trees, or animals. Examples of natural fibers include but are not limited to wood pulp fibers, cotton fibers, linen fibers, wool fibers, silk fibers, jute fibers, hemp fibers, milkweed fibers and the like, as well as combinations thereof. The wood pulp fibers in the air laid web may be in a rolled and fluffed form. "Synthetic fibers" as used herein include fibers derived from polypropylene, polyethylene, polyolefin, polyester, polyamides, and polyacrylics. "Synthetic fibers" as used herein also include regenerated cellulosic fibers such as viscose, rayon, cuprammonium rayon, and solvent-spun cellulose such as Lyocell. Combinations of synthetic fibers can be used. The synthetic fibers may be bi-component fibers with a core of polypropylene and a polyethylene sheath, or side-by-side bi-component fibers.

In general, the synthetic fibers will have fiber lengths greater than about 5.6 mm and therefore be classified as long fibers while the natural fibers will have fiber lengths less than about 5.5 mm and be classified as short fibers. Synthetic fibers can significantly reduce the throughput of the forming station 30, resulting in reduced output of the finished air laid web at a given basis weight when compared to the same basis weight web produced without any synthetic fibers. Therefore, controlling the total amount and location of the synthetic fibers in the air laid nonwoven web 32 is desirable in order to minimize any reduction in throughput.

If desired, low coarseness softwood fibers can be incorporated into the web. Low coarseness softwood fibers include, for instance, RAUMA CELL BIOBRIGHT TR pulp obtained from UPM-Kymmene, which is made from Scandinavian softwood fibers. The low coarseness softwood fibers can be defiberized by being processed through, for instance, a hammermill. Low coarseness softwood fibers typically have a relatively small diameter and are smaller in length than comparable fibers. The low coarseness softwood fibers can have a Pulp Coarseness Index of less than about 18 mg/100 m, such as less than about 16.5 mg/100 m. For instance, in one embodiment, the fibers may have a Pulp Coarseness Index of less than about 15 mg/100 m. The low coarseness softwood fibers may be used alone or in combination with various other fibers in forming the air laid web. Further, different types of low coarseness softwood fibers may be combined to form the web as well.

The pulp fibers used to form air laid webs in accordance with the present invention may be pretreated with a debonder agent prior to incorporation into the air laid web. Suitable debonder agents that may be used in the present invention include cationic debonder agents, such as fatty dialkyl quaternary amine salts, mono fatty alkyl tertiary amine salts, primary amine salts, imidazoline quaternary salts, silicone quaternary salt and unsaturated fatty alkyl amine salts. Other suitable debonder agents are disclosed in U.S. Pat. No. 5,529,665 to Kaun, which is incorporated herein by reference. In particular, Kaun discloses the use of cationic silicone compositions as debonder agents. A suitable commercially available debonder agent is an organic quaternary ammonium chloride and particularly a silicone based amine salt of a quaternary ammonium chloride such as PROSOFT TQ1003 marketed by the Hercules Corporation. The debonder agent can be added to the fibers in an amount of between about 1 kg per metric tonne to about 6 kg per metric tonne of fibers present.

When forming the air laid web 32 from different materials and fibers, the forming chamber 44 can include multiple inlets for feeding the materials to the chamber. Once in the chamber, the materials can be mixed together if desired. Alternatively, the different materials can be separated into different layers when forming the web.

Referring to FIG. 4, a schematic diagram of an entire web forming system useful for making air laid substrates is shown. In this embodiment, the system includes three separate air laying forming chambers 44A, 44B and 44C. As described above, the use of multiple forming chambers can serve to facilitate formation of a layered air laid web at a desired overall basis weight. As shown, forming stations 44A, 44B and 44C contribute to the formation of a single ply, layered, air laid web 32. In particular, forming chamber 44A can be used to make the second outer layer 23 of the nonwoven web 20, forming chamber 44B can be used to make the middle layer 22, and forming chamber 44C can be used to make the first outer layer 21 as the web travels from right to left under the forming chambers on the forming fabric 34. The type and selection of fibers and their respective fiber lengths sent to each forming chamber can be varied to make the layered dispersible nonwoven web 20.

In one embodiment, the first outer layer 21 comprised 90 weight percent Southern Softwood Kraft Fluff pulp short fibers (Weyerhaeuser CF405) and 10 weight percent synthetic long fibers (Lyocell having an average fiber length of 8 mm) expressed as a weight percent of the fiber mix feed to forming chamber 44C. The middle layer 22 comprised 100 weight percent CF405 wood pulp (short fibers) expressed as a weight percent of the fiber mix feed to forming chamber 44B. The second outer layer 21 comprised 90 weight percent CF405 wood pulp (short fibers) and 10 weight percent Lyocell synthetic fibers (long fibers) expressed as a weight percent of the fiber mix feed to forming chamber 44A.

Air laid web 32, after exiting the forming chambers 44A, 44B and 44C, can be conveyed on the forming fabric 34 to a compaction device 54. The compaction device 54 can be a pair of opposing rolls that define a nip through which the air laid web and forming fabric is passed. In one embodiment, the compaction device can comprise a steel roll 53 positioned above a covered roll 55, having a resilient roll covering for its outer surface. The compaction device increases the density of the air laid web to generate sufficient strength for transfer of the air laid web to a transfer fabric 56. In general, the compaction device increases the density of the web over the entire surface area of the web (calendering) as opposed to only creating localized high density areas (embossing).

The compaction rolls (53, 55) can be between about 10 inches to about 30 inches in diameter and can be optionally heated to further enhance their operation. For example, the steel roll can be heated to a temperature between about 150° F. to about 500° F. The compaction rolls can be operated at either a specified loading force or can be operated at specified gap between the surfaces of each roll. Too much compaction will cause the web to lose bulk in the finished product, while too little compaction can cause runnability problems when transferring the air laid web to the next section in the process.

Alternatively, the compaction device 54 can be eliminated and the transfer fabric 56 and the forming fabric 34 can be brought together such that the air laid web 32 is transferred from the forming fabric to the transfer fabric. The transfer efficiency can be enhanced by use of suitable vacuum transfer boxes and/or pressured blow boxes as known in the art.

After the air laid web 32 is transferred to the transfer fabric 56, it can be hydrated by a spray boom 58 with liquid such as water. The percent moisture of the air laid web after hydration, based as a weight percent of the total dry fibers in the web, can be between about 0.1 percent to about 5 percent, or between about 0.5 percent to about 4 percent, or between about 0.5 percent to about 2 percent. Too much moisture can cause the air laid web to adhere to the transfer fabric and not release for transfer to the next section of the process, while too little moisture can reduce the amount of optional texture generated in the web.

After hydration, the moistened air laid web, while residing on the transfer fabric 56, can be embossed by an embossing device 60 to make a textured air laid web 33. The embossing device can be an optionally heated engraved compaction roll 62 that is nipped with a backing roll 64 through which the air laid web 32 residing on the transfer fabric 56 is sent to make the textured air laid web 33. Alternatively, the embossing device 60 can be replaced with a second compaction device 54 or eliminated in other embodiments of the invention.

The compressibility of the transfer fabric along with the height and/or pattern of the engraved compaction roll 62, the degree of hydration, the temperature of the engraved compaction roll, and the nip load can be controlled to produce a desired texture or embossing pattern in the air laid web 33.

With regard to the transfer fabric 56, and specifically its interaction with the engraved compaction roll 62, by selecting fabrics having a specific compressibility a textured air laid web having superior texture is produced. The compressibility of the transfer fabric can be determined by measuring the depth of an indention made in the surface of the transfer fabric by a steel ball (3.175 mm diameter) under a constant load (1000 grams) for a specified time period (60 seconds). The measured indention is the Pusey and Jones number often abbreviated as the P&J hardness. Similar testing is frequently carried out on rubber covered rolls using a Plastometer Model 1000, or equivalent, to determine the rubber covered roll's P&J hardness. The instrument and method of testing is described in ASTM D 531 *Standard Test Method for Rubber Property—Pusey and Jones Indentation* and in Metso Paper No. 25 *Measuring the Hardness of Rubber Covered Rolls* (*Plastometer test*).

Use of the Plastometer to test the compressibility of a fabric can be done to select a transfer fabric having specific properties in order to produce a textured air laid web. In particular, the transfer fabric can have P&J hardness of between about 30 to about 150, or between about 50 to about 150, or between about 100 to about 150. Thus, transfer fabrics having too low of a hardness number will generate insufficient texture or no texture, while transfer fabrics having too great of a hardness number can have a very short running life.

With regard to compressibility and life of the transfer fabric, the denier of the yarns forming the transfer fabric can be controlled. Transfer fabrics having yarns with too fine of denier will have less than desired life, and those having yarns too large in denier will not have a sufficiently smooth surface for good transfer of the air laid web. The denier of the yarns forming the transfer fabric can be 10 or greater, or between about 10 to about 40, or between about 10 to about 25.

Suitable transfer fabrics for use can include paper machine felts having the specified P&J hardness range. For example, a Millennium Axxial felt is suitable for use. Millennium Axxial felts are available from Weavexx, a subsidiary of Xerium Technologies, Inc., having an office in Westborough Mass.

The pattern placed onto the engraved compaction roll can be any suitable pattern or icon that develops the desired texture. In particular, the pattern's Percent Bond Area is believed to be one factor that can be used to select an appropriate pattern. The Percent Bond Area is defined as the area of the raised embossing pattern on the embossing roll expressed as a percentage of the total area of the roll's surface that will be in contact with the web. This can be measured directly from the embossing roll by a number of methods or measured indirectly by measuring the embossed substrate produced by the embossed roll. The area used to calculate the Percent Bond Area should be sufficiently large to encompass at least one entire repeat of the embossing pattern. Embossing patterns suitable for use can have a Percent Bond Area between about 4 percent to about 50 percent, or between about 4 percent to about 25 percent, or between about 4 percent to about 15 percent or between about 6 percent to about 12 percent. The Percent Bond Area can be sufficiently large to generate adequate texture and strength in the web while not being too large, causing increased stiffness or bulk loss in the air laid web.

Figure 5:
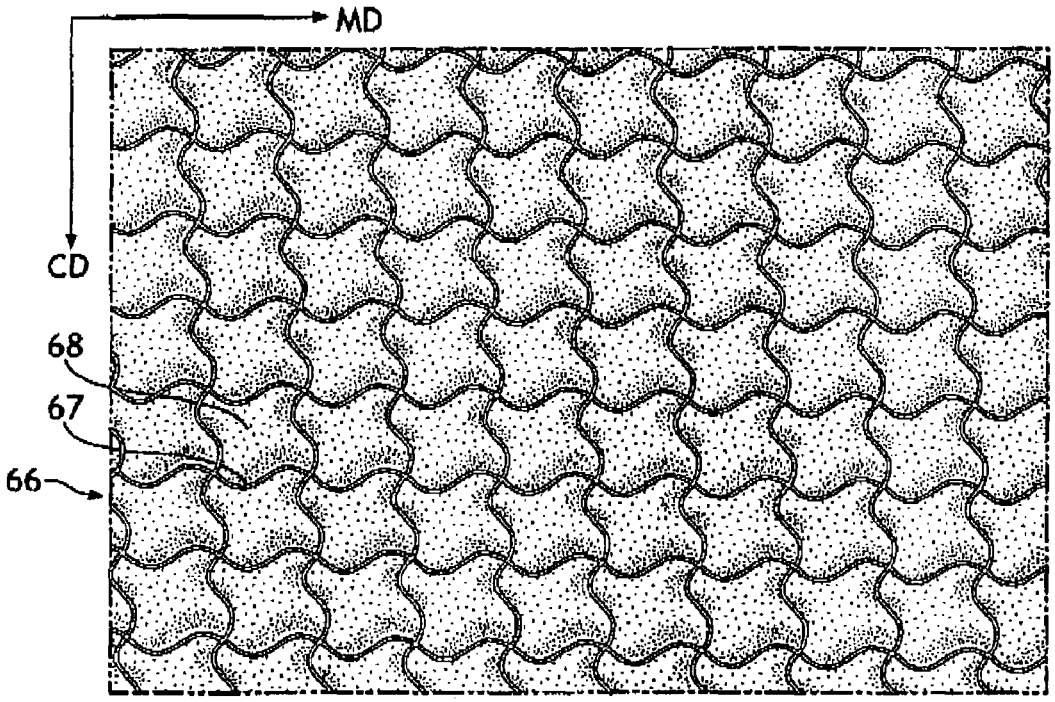
FIG. 5 illustrates a photograph of an air laid wet wipe substrate.
Figure 6:
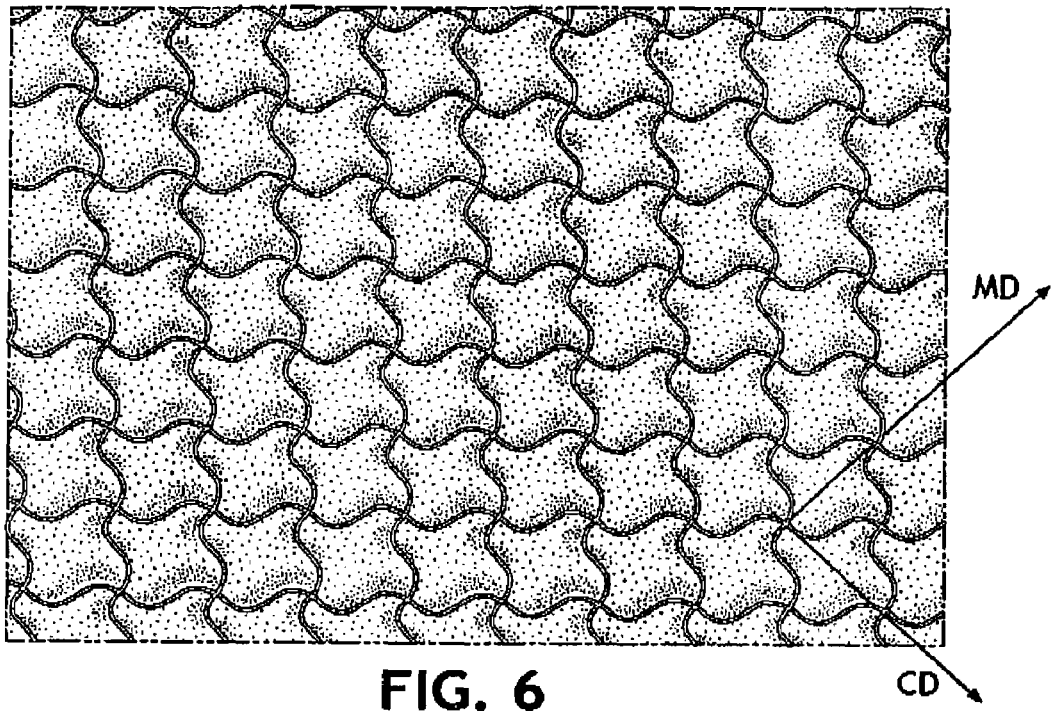
FIG. 6 illustrates a photograph of an air laid wet wipe substrate.
Figure 7:
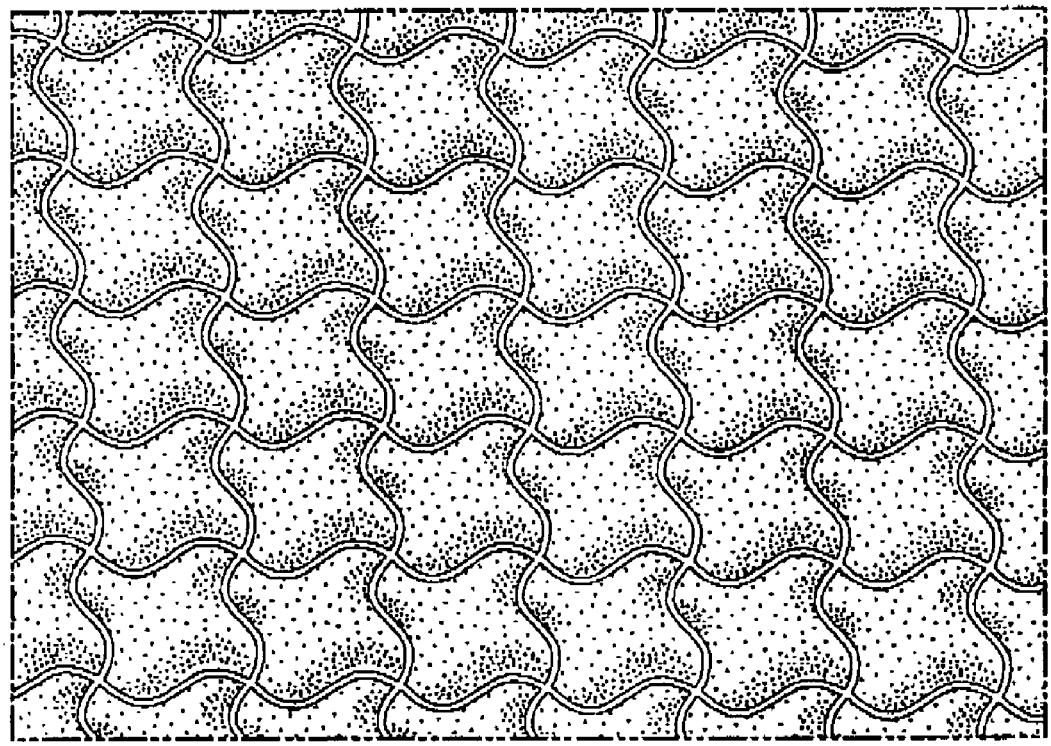
FIG. 7 illustrates a photograph of an air laid wet wipe substrate.
Figure 8:
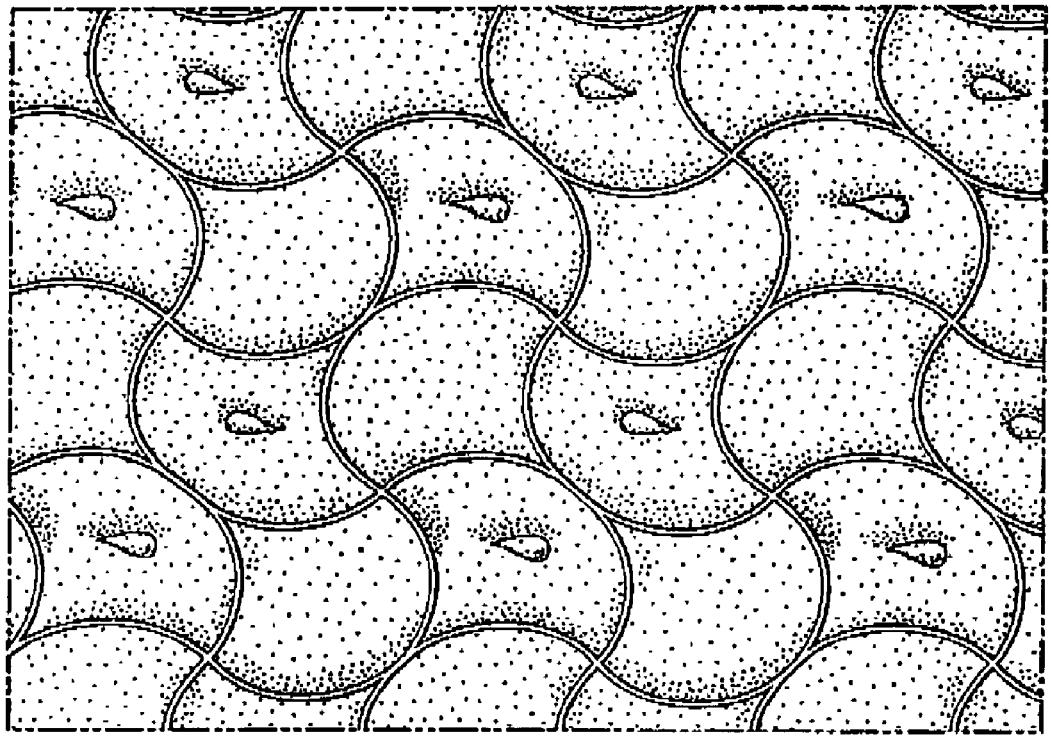
FIG. 8 illustrates a photograph of an air laid wet wipe substrate.

Referring now to FIGS. 5 through 8, the surface textures of several air laid webs are shown. The photographs are approximately 1.8 times larger the actual size. In FIGS. 5 and 6, the longer diagonal of a pillow region 68 when measured from corner to corner on the embossing surface was approximately 10 mm and the shorter diagonal was approximately 9 mm. The Percent Bond Area was calculated as 9.6 percent based on the engraving drawing. In FIG. 7, the longer diagonal of a pillow region 68 when measured from corner to corner on the embossing surface was approximately 14 mm and the shorter diagonal was approximately 13 mm. The Percent Bond Area was calculated as 7.2 percent based on the engraving drawing. In FIG. 8, the distance across the bottom of the large curve (across the bottom of the umbrella from canopy edge to canopy edge) when measured on the embossing surface was approximately 19 mm. The Percent Bond Area was calculated to be 5.7 percent based on the engraving drawing.

The type of pattern placed onto the air laid web can have an influence on the texture produced and the dispersibility of the nonwoven web 20. In one embodiment, as seen in FIGS. 5 through 8, the pattern can comprise a network pattern 66 wherein a plurality of embossed lines 67 forming the pattern are interconnected in two directions, such as the machine and cross machine directions in FIG. 5. The network pattern forms a plurality of pillow regions 68 that are completely enclosed by the plurality of interconnected embossed lines 67. In one embodiment, the pillow regions 68 had a wave star shape having four points and sinusoidal edges as shown in FIGS. 5 through 7. A "network pattern" as used herein means that the embossing pattern has a series of interconnected embossed lines that completely enclose a plurality of unembossed pillow regions such that the plurality of embossed lines form a lattice or mesh. As such, it is possible to traverse across the sample from the top to the bottom or from the left to the right by tracing a continuous embossed line. In other embodiments, the embossing pattern can be discrete objects such as animals, symbols, words, or icons that do not form a network pattern of interconnected lines. Alternatively, no embossing pattern may be used when the air laid nonwoven web is manufactured.

Without wishing to be bound by theory, it is believed that when the network pattern 66 is used it helps to not only strengthen the resulting dispersible nonwoven web 20, but also tends to increase the dispersibility of the dispersible nonwoven web containing the triggerable binder 26. The network pattern can increase the localized density of the fibers along the plurality of interconnected embossed lines 67 helping to increase the tensile strength of the dispersible nonwoven web 20. When the triggerable binder material 26 is applied to the web and cured, the triggerable binder causes a higher number of bonds to occur in these higher density areas forming a continuous network of locally higher strength along the interconnected embossed lines 67. This interconnected network of strength can result in more efficient use of the triggerable binder 26 by generating a higher tensile strength substrate with less triggerable binder.

After the nonwoven web is sprayed with the triggerable binder 26 and cured by forcing hot air through the web, an interesting effect can occur. Where the dispersible nonwoven web 20 has been densified by the network pattern 66 along the plurality of embossed lines 67, there may be less airflow through the web. In the pillow regions 68, more airflow through the web can occur. As a result, a triggerable binder or a salt triggerable binder can become more cured in the pillow regions 68 than in the plurality of interconnected embossed lines 67 by being subjected to more hot air passing through the web. When the dispersible nonwoven web 20 is placed into disposal water, the triggerable binder can dissolve more readily where it has been cured less along the plurality of interconnected embossed lines 67 in the network pattern 66. Thus, a nonwoven dispersible web 20 using a triggerable binder with the network pattern 66 as shown in FIG. 5 tends to break up into the shape of the pillow regions 66 (approximately square) first, and then to further disperse as the layers (21, 22, 23) continue to separate and break apart; especially, when utilizing a salt triggerable binder as disclosed in U.S. Pat. No. 7,157,389.

To further enhance the desirability of the textured dispersible nonwoven web 20, the orientation of the network pattern 66 can be controlled. As shown in FIG. 5, the network pattern 66 is orientated such that the plurality of embossed lines 67 are substantially oriented in the machine direction (MD) and cross machine direction (CD) of the web. If the dispersible nonwoven web 20 is later perforated into individual sheets, the perforation lines are commonly oriented in either the MD or CD. Depending on the perforation repeat length and the network pattern size, it is possible to have one set of perforations align substantially on an interconnected embossed line 67 (either vertical or horizontal) and another set of perforations align substantially in the middle of the pillow regions 68. This can lead to significant variability in the perforation detach strength since the localized web strength can vary between the pillow regions 68 and the embossed lines 67 as discussed above. One method to improve the variability in the perforation detach strength is to rotate the textured pattern of FIG. 5 relative to the MD or CD as shown in FIG. 6. In one embodiment, the pattern of FIG. 5 was rotated approximately 45 degrees such that the plurality of embossed lines 67 created angles of approximately 45 degrees to the respective MD and CD of the web as shown in FIG. 6. As such, when the textured nonwoven dispersible web 20 with the rotated pattern is perforated into sheets, the perforation lines generally do not align with any of the plurality of embossed lines 67 forming the network pattern 66. Instead the perforations will cut across the plurality of interconnected embossed lines 67 at an angle as shown by the MD or CD arrows in FIG. 6. The plurality of interconnected embossed lines 67 do not substantially align with either the MD or the CD of the dispersible nonwoven substrate as shown in FIG. 6.

The engraved compaction roll 62 can have an engraving depth between about 0.020 inch to about 0.100 inch, or between about 0.025 inch to about 0.060 inch, or between about 0.030 inch to about 0.050 inch as measured from the top of the engraving elements to their base. If the embossing pattern is too shallow, less texture will be generated in the air laid web since the interaction of the embossing pattern with the transfer fabric will be insufficient, especially as the P&J hardness of the transfer fabric decreases.

To enhance the texture generated by the engraved compaction roll 62, the engraved compaction roll can be heated. The compaction roll 62 can be heated to a temperature ranging between about 150° F. to about 500° F., between about 200° F. to about 500° F., or between about 250° F. to about 500° F.

The backing roll 64 can be a steel roll or a rubber covered roll having either a natural or synthetic compressible cover. The engraved compaction roll and the backing roll can have a diameter between about 10 inches to about 30 inches. The engraved compaction roll and the backing roll can be loaded together with a nip load expressed in pounds force per lineal inch (pli) of between about 50 pli to about 400 pli, such as between about 200 pli to about 300 pli. The nip load chosen is often dependent on the line speed of the machine, since the load force as a function of time (dwell time) in the nip represents the energy available for embossing the air laid web.

Next, the textured air laid web 33 is transferred to a spray fabric 70A and fed to a spray chamber 72A. Within the spray chamber 72A, a triggerable binder 26 is applied to one side of the textured air laid web 33. The triggerable binder can be deposited on the top side of the web using, for instance, spray nozzles. Under fabric vacuum may also be used to regulate and control penetration of the triggerable binder into the web. The triggerable binder 26 applied to the air laid web can be selected such that the triggerable binder retains the web's texture, if any, when moistened with a wetting solution containing an insolubilizing agent to form a wet wipe. One suitable salt triggerable binder uses NaAMPS SSB as disclosed in U.S. Pat. No. 6,683,143. Another salt triggerable binder uses a low charge density, cationic polyacrylate comprising the polymerization product of a vinyl-functional cationic monomer, a hydrophobic vinyl monomer with a methyl side chain, and one or more hydrophobic vinyl monomers with alkyl side chains of 1 to 4 carbon atoms as disclosed in U.S. Pat. No. 7,157,389. In other embodiments, the triggerable binder can comprise the binder composition claimed by claims 18, 25 or 26 of U.S. Pat. No. 7,157,389.

Triggerable binder materials can require the addition of more triggerable binder material to generate sufficient tensile strength in the dispersible nonwoven web 20 as opposed to using non-triggerable binders such as latex compositions, acrylates, vinyl acetates, vinyl chlorides, and methacrylates. The additional triggerable binder material applied to the web can increase the wetness or moisture content of the air laid web prior to drying. Thus, the spray chamber 72A can "wash out" a pattern embossed onto the web when making a textured dispersible nonwoven web since the texture has yet to be locked in by curing and drying of the triggerable binder material. The additional moisture from the additional triggerable binder present can cause the textured pattern within the substrate to relax or fade. By utilizing a compressible transfer fabric 56, sufficient texture is generated such that dispersible air laid webs can be made that resist relaxation of the embossing pattern prior to curing and drying.

The triggerable binder material can be applied so as to uniformly cover the entire surface area of at least one side of the web. For instance, the triggerable binder material can be applied to the first side of the web so as to cover at least about 80 percent of the surface area of one side of the web, such as at least about 90 percent of the surface area of one side of the web. In other embodiments, the triggerable binder material can cover greater than about 95 percent of the surface area of one side of the web.

The triggerable binder material should be applied to the air laid web in an amount sufficient to generate adequate in-use wet tensile strength. In particular, the amount of the triggerable binder material can be about 10 percent to about 25 percent of the total weight of the dispersible nonwoven web. The amount of triggerable binder required is determined by the desired wet tensile strength and caliper of the basesheet among other factors.

Once the triggerable binder material is applied to one side of the web, as shown in FIG. 2, the air laid web 33 is transferred to drying fabric 80A and fed to a drying apparatus 82A. In the drying apparatus 82A, the web is subjected to heat causing the triggerable binder material to dry and/or cure. From the drying apparatus 82A, the air laid web is then transferred to a second spray fabric 70B and fed to a second spray chamber 72B. In the second spray chamber 72B, a second triggerable binder material is applied to the other untreated side of the air laid web. The first triggerable binder material and the second triggerable binder material can be the same or different triggerable binder materials. The second triggerable binder material may be applied to the air laid web as described above with respect to the first triggerable binder material.

From the second spray chamber 72B, the textured air laid web is then transferred to a second drying fabric 80B and passed through a second drying apparatus 82B for drying and/or curing the second triggerable binder material. From the second drying apparatus 82B, the textured air laid web 33 is transferred to a return fabric 90 and then wound into a roll or reel 92. After winding, subsequent converting steps known to those of skill in the art can be used to transform the dispersible nonwoven web 20 into a plurality of wet wipes. For example, the dispersible nonwoven web 20 can be cut into individual wipes, the individual wipes folded into a stack, the stack of wet wipes moistened with a solution containing an insolubilizing agent for the triggerable binder, and the stack of wet wipes placed into a suitable dispenser or package.

The basis weight of the dispersible nonwoven web 20 can vary depending on the particular application and the desired use. For most embodiments, for instance, the basis weight of the dispersible nonwoven web can be from about 35 gsm to about 120 gsm, such as from about 50 gsm to about 80 gsm.

The strength of the dispersible nonwoven web 20 of the present invention can vary depending on the particular application and desired use. For most embodiments, the MDWT tensile strength when saturated with the wetting solution containing a sufficient quantity of the insolubilizing agent can be between about 1,000 g/3" to about 2,000 g/3" such as between about 1,250 g/3" to about 1,750 g/3".

The dispersible nonwoven web 20 can be used to make a wet wipe by wetting the web with an appropriate solution containing a sufficient quantity of an insolubilizing agent. For example, wet wipes used to clean babies may have lower levels and different types of surfactants and active chemicals than wet wipes used to clean household surfaces. Wet wipes used to polish or clean cars may have different active ingredients from wet wipes intended for personal cleaning. The cleaning solution may contain, but is not limited to, surfactants, humectants, conditioners, fragrances, antibacterial agents, and the appropriate insolubilizing agent for the triggerable binder used. The solution add-on as a weight percent of the dry weight of the basesheet can be between about 150 percent to about 350 percent. One suitable cleaning solution is disclosed in U.S. Pat. No. 6,673,358 issued to Cole et al. on Jan. 6, 2004 and herein incorporated by reference. When using a salt triggerable binder, approximately 1 weight percent to approximately 10 weight percent of salt can be added to the wetting solution to prevent the dispersible nonwoven web from dispersing until placed into disposal water.

EXAMPLES

Example 1

Example 1 was produced on a commercial airlaid machine using a process similar to FIG. 2. Southern Softwood Kraft Fluff pulp short fibers (Weyerhaeuser CF 405) was defiberized using DanWeb Type H 60 M hammermills operating at 3000 rpm. The fibers were transported to forming heads (Dan Web manufacture) operating at a needle roll speed of 4920 fpm and forming drum speed of 920 fpm. The pulp fiber was mixed with solvent spun cellulosic fibers (Lyocell) long fibers having an average fiber length of 8 mm supplied by Lenzing Fibres. The first outer layer 21 comprised 90 weight percent CF405 (short fibers) and 10 weight percent Lyocell synthetic fibers (long fibers) expressed as a weight percent of the fiber mix feed to forming chamber 44C. The middle layer 22 comprised 100 weight percent CF405 wood pulp (short fibers) expressed as a weight percent of the fiber mix feed to forming chamber 44B. The second outer layer 21 comprised 90 weight percent CF405 wood pulp (short fibers) and 10 weight percent Lyocell synthetic fibers (long fibers) expressed as a weight percent of the fiber mix feed to forming chamber 44A.

The fibers were then deposited onto a forming fabric (Albany ElectroTech 100S) and formed into a layered web. The embryonic web was then densified and strengthened by passing through the first set of compaction rolls. The top compaction roll was a smooth steel induction-heated roll (Tokuden, Inc.) which directly contacts the web and was operating at 275° F.

The web was then transferred with vacuum to a Weavexx Axxial Millennium felt installed in the transfer section having a P&J hardness of approximately 57. The web was then humidified with water at an add-on of approximately 1.5 percent by weight based on the web's basis weight. Immediately thereafter, the web was further densified and strengthened by passing through the second set of compaction rolls. The bottom compaction roll was an engraved steel induction-heated roll (Tokuden, Inc.) which directly contacts the web and was operating at 350° F. at a nip load of 250 pli. The network engraving pattern used is shown in FIG. 5.

The web was then transferred to the spray chamber 72A section. An L7170 salt triggerable binder, a polyacrylate binder as disclosed in U.S. Pat. No. 7,157,389 available from Bostik Findley, was then applied to the web via spray boom at 15 percent solids and an add-on of approximately 6.3 percent by total sheet weight. The polyacrylate binder was mixed with a vinyl-acetate ethylene latex co-binder (AirFlex EZ123®) available from Air Products. The binder to co-binder ratio was approximately 70:30. The co-binder add-on was approximately 1.9 percent by total sheet weight. The web was then transferred to a multi-zone dryer operating at 400° F. to evaporate water and cure the binder. The web was then transferred to the spray chamber 72B section. The L7170 salt triggerable binder and AirFlex EZ123® co-binder (70:30 ratio) was then applied to the opposite side of the web via spray boom at 15 percent solids resulting in an L7170 add-on of approximately 6.3 percent by total sheet weight and an AirFlex EZ123® add-on of approximately 1.90 percent by total sheet weight. The web was then transferred to a multi-zone dryer operating at 400° F. to evaporate water and cure the binder.

After the second dryer pass, the web was transferred to the reel section and wound into roll form. The basis weight of the air laid web was measured at 71.3 gsm. The air laid web was used to make a wet wipe by adding approximately 235 percent by weight (2.5 times the weight of the substrate) of a cleaning solution containing approximately 95 percent water and 5 percent active ingredients comprising Propylene Glycol, DMDM Hydantoin, Disodium Cocoamphodiacetate, Polysorbate 20, Fragrance, Iodopropynyl Butylcarbamate, Aloe Barbadensis, Tocopheryl Acetate, and approximately 2 weight percent sodium chloride as the insolubilizing agent. The Percent Bond Area was measured by optical analysis from the markings left on nip impression paper passed between the compaction rolls and the transfer fabric. The resulting dispersible nonwoven web had the physical properties as shown in Table 1 and a Percent Bond Area of 7.7 percent.

Example 2

Example 2 was produced using the steps for Example 1 except the fiber splits per layer were adjusted as follows. The first outer layer 21 comprised 90 weight percent CF405 (short fibers) and 10 weight percent Lyocell synthetic fibers (long fibers) expressed as a weight percent of the fiber mix feed to forming chamber 44C. The middle layer 22 comprised 90 weight percent CF405 wood pulp (short fibers) and 10 weight percent Lyocell synthetic fibers expressed as a weight percent of the fiber mix feed to forming chamber 44B. The second outer layer 21 comprised 90 weight percent CF405 wood pulp (short fibers) and 10 weight percent Lyocell synthetic fibers (long fibers) expressed as a weight percent of the fiber mix feed to forming chamber 44A. The resulting dispersible nonwoven web had the physical properties as shown in Table 1 and a Percent Bond Area of 7.7 percent.

Example 3

Example 3 was produced using the steps for Example 1 except the fiber splits per layer were adjusted as follows. The first outer layer 21 comprised 93.3 weight percent CF405 (short fibers) and 6.7 weight percent Lyocell synthetic fibers (long fibers) expressed as a weight percent of the fiber mix feed to forming chamber 44C. The middle layer 22 comprised 93.3 weight percent CF405 wood pulp (short fibers) and 6.7 weight percent Lyocell synthetic fibers expressed as a weight percent of the fiber mix feed to forming chamber 44B. The second outer layer 21 comprised 93.3 weight percent CF405 wood pulp (short fibers) and 6.7 weight percent Lyocell synthetic fibers (long fibers) expressed as a weight percent of the fiber mix feed to forming chamber 44A. The resulting dispersible nonwoven web had the physical properties as shown in Table 1 and a Percent Bond Area of 7.7 percent.

Example 4

Example 4 was produced using the steps for Example 1 except the fiber splits per layer were adjusted as follows. The first outer layer 21 comprised 71.5 weight percent CF405 (short fibers) and 19.5 weight percent Lyocell synthetic fibers (long fibers) expressed as a weight percent of the fiber mix feed to forming chamber 44C. The middle layer 22 comprised 100 weight percent CF405 wood pulp (short fibers) as a weight percent of the fiber mix feed to forming chamber 44B. The second outer layer 21 comprised 71.5 weight percent CF405 wood pulp (short fibers) and 19.5 weight percent Lyocell synthetic fibers (long fibers) expressed as a weight percent of the fiber mix feed to forming chamber 44A. The resulting dispersible nonwoven web had the physical properties as shown in Table 1 and a Percent Bond Area of 7.7 percent.

Example 5

Example 5 was produced using the steps for Example 1 except the fiber splits per layer were adjusted as follows. The first outer layer 21 comprised 87.0 weight CF405 (short fibers) and 13.0 weight percent Lyocell synthetic fibers (long fibers) expressed as a weight percent of the fiber mix feed to forming chamber 44C. The middle layer 22 comprised 87.0 weight percent CF405 wood pulp (short fibers) and 13.0 weight percent Lyocell synthetic fibers expressed as a weight percent of the fiber mix feed to forming chamber 44B. The second outer layer 87.0 comprised 13.0 weight percent CF405 wood pulp (short fibers) and 6.7 weight percent Lyocell synthetic fibers (long fibers) expressed as a weight percent of the fiber mix feed to forming chamber 44A. The resulting dispersible nonwoven web had the physical properties as shown in Table 1 and a Percent Bond Area of 7.7 percent.

Example 6

Example 6 was produced using the steps for Example 1 except the fiber splits per layer were adjusted as follows. The first outer layer 21 comprised 87.0 weight CF405 (short fibers) and 13.0 weight percent Lyocell synthetic fibers (long fibers) expressed as a weight percent of the fiber mix feed to forming chamber 44C. The middle layer 22 comprised 87.0 weight percent CF405 wood pulp (short fibers) and 13.0 weight percent Lyocell synthetic fibers expressed as a weight percent of the fiber mix feed to forming chamber 44B. The second outer layer 87.0 comprised 13.0 weight percent CF405 wood pulp (short fibers) and 6.7 weight percent Lyocell synthetic fibers (long fibers) expressed as a weight percent of the fiber mix feed to forming chamber 44A. The co-binder was changed from AirFlex EZ123® to Rhoplex ECO-4015 supplied by Rohm & Haas. The web was not embossed with a network embossing pattern and had a smooth surface. The resulting dispersible nonwoven web had the physical properties as shown in Table 1.

Example 7

Example 7 was produced using the steps for Example 1 except the fiber splits per layer were adjusted as follows. The first outer layer 21 comprised 87.0 weight CF405 (short fibers) and 13.0 weight percent Lyocell synthetic fibers (long fibers) expressed as a weight percent of the fiber mix feed to forming chamber 44C. The middle layer 22 comprised 87.0 weight percent CF405 wood pulp (short fibers) and 13.0 weight percent Lyocell synthetic fibers expressed as a weight percent of the fiber mix feed to forming chamber 44B. The second outer layer 87.0 comprised 13.0 weight percent CF405 wood pulp (short fibers) and 6.7 weight percent Lyocell synthetic fibers (long fibers) expressed as a weight percent of the fiber mix feed to forming chamber 44A. The co-binder was changed from AirFlex EZ123® to Rhoplex ECO-4015 supplied by Rohm & Haas. The resulting dispersible nonwoven web had the physical properties as shown in Table 1 and a Percent Bond Area of 7.7 percent.

Results

Tables 1, 2 and 3 summarize the testing results and specific properties of the Examples.

TABLE 1

| | Example 1 | Example 2 | Example 3 |
|---|---|---|---|
| Percent of long fibers as weight percent of fiber mix feed to each layer | 10.0% Layer 21<br>0.00% Layer 22<br>10.0% Layer 23 | 10.0% Layer 21<br>10.0% Layer 22<br>10.0% Layer 23 | 6.7% Layer 21<br>6.7% Layer 22<br>6.7% Layer 23 |
| Percent of long fibers as percent of total basis weight of nonwoven web | 6.7% | 10% | 6.7% |
| MDWT (g/in) | 343.6 | 342.7 | 338.8 |
| 3 Hr Shake Flask 12 mm screen weight % pass | 100% | 100% | 100% |
| 3 Hr Shake Flask 6 mm screen weight % pass | 95% | 80% | 90% |
| 3 Hr Shake Flask 3 mm screen weight % pass | 91% | 70% | 77% |
| Dry caliper (mm) | 1.2 | 1.2 | 1.2 |
| Basis weight (gsm) | 72.1 | 73.4 | 74.8 |

TABLE 2

| | Example 4 | Example 5 |
|---|---|---|
| Percent of long fibers as weight percent of fiber mix feed to each layer | 19.5% Layer 21<br>0.00% Layer 22<br>19.5% Layer 23 | 13.0% Layer 21<br>13.0% Layer 22<br>13.0% Layer 23 |
| Percent of long fibers as percent of total basis weight of nonwoven web | 13.0% | 13.0% |
| MDWT (g/in) | 416.3 | 389.6 |
| 3 Hr Shake Flask 12 mm screen weight % pass | 100% | 99.9% |

TABLE 2-continued

| | Example 4 | Example 5 |
|---|---|---|
| 3 Hr Shake Flask 6 mm screen weight % pass | 95.4% | 90.1% |
| 3 Hr Shake Flask 3 mm screen weight % pass | 94.2% | 86.2% |
| Dry caliper (mm) | 1.4 | 1.3 |
| Basis weight (gsm) | 73.3 | 69.0 |

TABLE 3

| | Example 6 | Example 7 |
|---|---|---|
| Percent of long fibers as weight percent of fiber mix feed to each layer | 13.0% Layer 21<br>13.0% Layer 22<br>13.0% Layer 23 | 13.0% Layer 21<br>13.0% Layer 22<br>13.0% Layer 23 |
| Percent of long fibers as percent of total basis weight of nonwoven web | 13.0% | 13.0% |
| MDWT (g/in) | 467.7 | 452.3 |
| 3 Hr Shake Flask 12 mm screen weight % pass | 100% | 100% |
| 3 Hr Shake Flask 6 mm screen weight % pass | 90% | 96% |
| 3 Hr Shake Flask 3 mm screen weight % pass | 88% | 92% |
| Dry caliper (mm) | 1.0 | 1.2 |
| Basis weight (gsm) | 70.7 | 71.8 |

Examples 1, 2 and 3 using a salt triggerable binder had comparable MDWT strengths when immersed in a wetting composition containing approximately 2 weight percent of sodium chloride. The three Examples also had comparable dry calipers, and basis weights. However, Example 1 containing no long fibers in the middle layer 22 had a significantly improved dispersibility rate as measured by the Dispersibility Shake Flask Test. In particular, Example 1 broke up into smaller pieces as evidenced by the higher weight % pass values for the 6 mm screen and the 3 mm screen. Thus, even though Example 1 had a similar MDWT strength as Examples 2 and 3, Example 1 dispersed much faster when the long fibers were placed into only the outer layers (21, 23) when manufactured to a similar basis weight.

Examples 4 and 5 using a salt triggerable binder had comparable MDWT strengths when immersed in a wetting composition containing approximately 2 weight percent of sodium chloride. Examples 4 and 5 also had comparable dry calipers, and basis weights. However, Example 4 containing no long fibers in the middle layer 22 had a significantly improved dispersibility rate as measured by the Dispersibility Shake Flask Test. In particular, Example 4 broke up into smaller pieces as evidenced by the higher weight % pass values for the 6 mm screen and the 3 mm screen. Thus, even through Example 4 had a similar MDWT strength as Example 5, Example 4 dispersed much faster when the long fibers were placed into only the outer layers (21, 23) when manufactured to a similar basis weight.

Examples 6 and 7 show the results of using a network embossing pattern to improve dispersibility. The main difference between the two samples was Example 7 was embossed with the pattern of FIG. 5, and Example 6 was not embossed and had a smooth calendered surface. Example 7 with the network embossing pattern had improved dispersibility as evidenced by the higher weight % pass values for the 6 mm screen and the 3 mm screen.

Test Methods

Percent Bond Area

The Percent Bond Area is defined as the area of the raised embossing pattern on the embossing roll expressed as a percentage of the total area of the roll's surface. Preferably, the Percent Bond Area is calculated directly from the engraving drawing. If the drawing is not available, the surface of the actual engraving roll can be used to measure the respective areas. Alternatively, nip impression paper can be marked by the embossing pattern under the process conditions used and the marks on the nip impression paper measured. The size of the representative area used to calculate the Percent Bond Area should be sufficiently large to encompass at least one entire repeat of the embossing pattern. For example, a computer aided drafting program can be used to calculate the area of the top surfaces of the male embossing elements and the entire area of the roll from an engineering drawing. The Percent Bond Area can be determined by taking the ratio of the area of the top flat surface of the embossing elements divided by the entire area and then multiplying by 100. Alternatively, when the engraving drawing or engraving roll is not accessible because a competitive product is being analyzed, the surface of the textured substrate can be measured by optical means known to those of skill in the art to accurately measure the embossed area of the substrate as a percent of the total area.

Strength Testing

Unless otherwise specified, tensile testing is performed according to the following protocol. Testing of substrate should be conducted under TAPPI conditions (50 percent relative humidity, 73° F.) with a procedure similar to ASTM-1117-80, section 7. Testing is conducted on a tensile testing machine maintaining a constant rate of elongation, and the width of each specimen tested was 3 inches. The "jaw span" or the distance between the jaws, sometimes referred to as gauge length, may range from about 2.0 inches (50.8 mm) to about 4.0 inches (100.6 mm). Typically, the 2-inch gauge length is used to measure the cross direction tensile for precut materials such as rolls of bathroom tissue and the 4-inch gauge length is used to measure the machine direction tensile. The crosshead speed is 12 inches per minute (254 mm/min.). A load cell or full-scale load is chosen so that all peak load results fall between 10 and 90 percent of the full-scale load. Such testing may be done on an Instron 1122 tensile frame connected to a Sintech data acquisition and control system utilizing IMAP software or equivalent system. This data system records at least 20 load and elongation points per second. Peak load (for tensile strength) and elongation at peak load (for stretch) are measured. At least ten samples for each test condition are tested and the average peak load or average stretch value is reported.

For cross direction (CD) tensile tests, the sample is cut in the cross machine direction. For machine direction (MD) tensile tests, the sample is cut in the machine direction. Cross direction wet tensile tests (CDWT) or machine direction wet tensile strength (MDWT) are performed as described above using the pre-moistened sample as is after the sample has equilibrated for temperature by sitting overnight in a sealed plastic bag.

For tests related to strength loss in a premoistened web occurring after exposure to a new solution, a container having dimensions of 200 mm by 120 mm and deep enough to hold 1000 ml is filled with 700 ml of the selected soak solution. No more than 108 square inches of sample are soaked in the 700 ml of soaking solution, depending on specimen size. The premoistened specimens, that have equilibrated overnight, are immersed in the soak solution and then allowed to soak undisturbed for a specified time period (typically 1 hour). At the completion of the soak period, samples are carefully retrieved from the soak solution, allowed to drain, and then tested immediately as described above (i.e., the sample is immediately mounted in the tensile tester and tested). In cases with highly dispersible materials, the samples often cannot be retrieved from the soaking solution without falling apart. The soaked tensile values for such samples are recorded as zero for the corresponding solution. The average of all tests conducted, both zero and non-zero, are reported.

For the deionized water soaked wet tensile test, S-WT, the sample is immersed in deionized water for 1 hour and then tested in the MD or CD as desired. For the hard-water soaked cross direction wet tensile test, S-WT-M (M indicating divalent metal ions), the sample is immersed in water containing 200 ppm of $Ca^{++}/Mg^{++}$ in a 2:1 ratio (133 ppm Ca++/67 ppm Mg++) prepared from calcium chloride and magnesium chloride, soaked for one hour and then tested in the MD or CD.

Dispersibility Shake Flask Testing

The test is conducted similar to ASTM E 1279-89 (Reapproved 1995) *Standard Test Method for Biodegradation By Shake-Flask Die-Away Method*. The test is used to simulate the physical forces acting to disintegrate the product during passage through household sewage pumps and municipal conveyance systems. ASTM E 1279 is modified by testing the whole product in a 3 L flask containing 1 L of tap water and shaken on a rotary shaker table for 3 hours. The flasks are removed and the contents passed through a series of screens. The various size fractions retained on the screens are weighed to determine the rate and extent of product disintegration.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A product comprising:

a dispersible nonwoven web having at least three layers, a first outer layer, a middle layer, and a second outer layer;

the first and the second outer layers comprising a plurality of short fibers and a triggerable binder, and at least one of the first or second outer layers comprising a plurality of long fibers;

the middle layer comprising a plurality of short fibers, a triggerable binder, and optionally a plurality of long fibers; and wherein a weight percent of the long fibers in at least one of the first or the second outer layers is greater than a weight percent of the long fibers in the middle layer.

2. The product of claim 1 wherein the middle layer comprises zero weight percent long fibers and both the first and second outer layers comprise a plurality of long fibers.

3. The product of claim 1 wherein the triggerable binder comprises a salt triggerable binder.

4. The product of claim 3 wherein the salt triggerable binder comprises a cationic polyacrylate comprising the polymerization product of a vinyl-functional cationic monomer, a hydrophobic vinyl monomer with a methyl side chain, and one or more hydrophobic vinyl monomers with alkyl side chains of 1 to 4 carbon atoms.

5. The product of claim 1 wherein the long fibers comprise about 1 percent to about 15 percent of the total weight of fibers present in the dispersible nonwoven web.

6. The product of claim 1 wherein the long fibers comprise from about 5 percent to about 12 percent of the total weight of the fibers present in the dispersible nonwoven web.

7. The product of claim 2 wherein the long fibers comprise from about 5 percent to about 12 percent of the total weight of the fibers present in the dispersible nonwoven web.

8. The product of claim 1 wherein the long fibers comprise from about 8 percent to about 26 percent of the total weight of the fiber mix in at least one of the first or the second outer layers.

9. The product of claim 2 wherein the long fibers comprise from about 10 percent to about 24 percent of the total weight of the fiber mix in both the first and the second outer layers.

10. The product of claim 1 wherein the weight percent of the triggerable binder is greater in both the first and second outer layers than the weight percentage of the triggerable binder in the middle layer.

11. A product comprising:

a dispersible nonwoven web having at least three layers, a first outer layer, a middle layer, and a second outer layer;

the first and the second outer layers comprising a plurality of short fibers and a triggerable binder, at least one of the first or second outer layers comprising a plurality of long fibers; and at least one of the first or second outer layers comprising a network embossing pattern;

the middle layer comprising a plurality of short fibers, a triggerable binder, and optionally a plurality of long fibers; and wherein a weight percent of the long fibers in at least one of the first or the second outer layers is greater than a weight percent of the long fibers in the middle layer.

12. The product of claim 11 wherein the network embossing pattern comprises a plurality of interconnected embossing lines enclosing a plurality of pillow regions, and the plurality of pillow regions comprising a wave star shape including four points and sinusoidal edges.

13. The product of claim 11 wherein the network pattern comprises a plurality of interconnected embossing lines, and the plurality interconnected embossing lines do not substantially align with the MD and CD of the dispersible nonwoven web.

14. The product of claim 11 wherein the middle layer comprises zero weight percent long fibers and both the first and second outer layers comprise a plurality of long fibers.

15. The product of claim 11 wherein the triggerable binder comprises a salt triggerable binder.

16. The product of claim 11 wherein the long fibers comprise about 1 percent to about 15 percent of the total weight of fibers present in the dispersible nonwoven web.

17. The product of claim 11 wherein the long fibers comprise from about 5 percent to about 12 percent of the total weight of the fibers present in the dispersible nonwoven web.

18. The product of claim 14 wherein the long fibers comprise from about 5 percent to about 12 percent of the total weight of the fibers present in the dispersible nonwoven web.

19. The product of claim 11 wherein the long fibers comprise from about 8 percent to about 26 percent of the total weight of the fiber mix in at least one of the first or the second outer layers.

20. The product of claim 14 wherein the long fibers comprise from about 10 percent to about 24 percent of the total weight of the fiber mix in both the first and the second outer layers.

21. The product of claim 11 wherein the weight percent of the triggerable binder is greater in both the first and second outer layers than the weight percentage of the triggerable binder in the middle layer.

* * * * *